US008443572B2

(12) United States Patent
Ellen

(10) Patent No.: US 8,443,572 B2
(45) **Date of Patent: *May 21, 2013**

(54) BUILDING METHODS

(75) Inventor: Murray Ellen, North Ryde (AU)

(73) Assignee: S2 Holdings Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/821,919

(22) Filed: Jun. 23, 2010

(65) Prior Publication Data

US 2010/0257814 A1 Oct. 14, 2010

Related U.S. Application Data

(63) Continuation of application No. 11/572,407, filed as application No. PCT/AU2005/001077 on Jul. 21, 2005, now abandoned.

(30) Foreign Application Priority Data

Jul. 21, 2004 (AU) ..... 2004904034

(51) Int. Cl.
*E04B 1/00* (2006.01)

(52) U.S. Cl.
USPC ..... 52/745.19; 52/73; 52/223.1; 52/223.8; 52/231; 52/745.15

(58) Field of Classification Search
USPC ..... 52/73, 223.1, 223.8, 231, 223.11, 52/745.19
See application file for complete search history.

(56) References Cited

U.S. PATENT DOCUMENTS

| | | | |
|---|---|---|---|
| 1,554,061 | A | 9/1925 | Wylie |
| 1,686,910 | A | 10/1928 | Frease |
| 2,234,663 | A | 3/1941 | Anderegg |
| 2,675,695 | A | 4/1954 | Coff |
| 2,822,068 | A | 2/1958 | Hendrix |
| 2,877,506 | A | 3/1959 | Almoslino |
| 2,986,246 | A | 5/1961 | Lester |
| 3,010,257 | A | 11/1961 | Naillon |
| 3,247,635 | A | 4/1966 | Burns |
| 3,251,162 | A | 5/1966 | Strimple |

(Continued)

FOREIGN PATENT DOCUMENTS

| | | | |
|---|---|---|---|
| AU | 61086/90 | A | 2/1991 |
| CA | 2 137 051 | A | 1/1996 |

(Continued)

OTHER PUBLICATIONS

Portal. (n.d.). Collins English Dictionary—Complete & Unabridged 10th Edition. Retrieved Apr. 4, 2012, from Dictionary.com website: http://dictionary.reference.com/browse/portal.*

*Primary Examiner* — Brian Glessner
*Assistant Examiner* — Joshua Ihezie
(74) *Attorney, Agent, or Firm* — Fitch, Even, Tabin & Flannery LLP

(57) ABSTRACT

A method of building a structure, the method including the steps of: 1. fabricating a generally longitudinal, steel substructure of the structure with a cable retainer attached to, or forming part of, the substructure and that extends substantially longitudinally therealong; 2. assembling the sub-structure into a structure; 3. inserting a cable into the cable retainer; 4. after step 2, applying a tensile force to the cable relative to the cable retainer; and 5. after step 4, bonding the cable to the cable retainer.

15 Claims, 8 Drawing Sheets

U.S. PATENT DOCUMENTS

| | | | |
|---|---|---|---|
| 3,280,521 | A | 10/1966 | Keathly |
| 3,341,995 | A | 9/1967 | Docken |
| 3,362,117 | A | 1/1968 | Raden |
| 3,778,946 | A | 12/1973 | Wood et al. |
| 3,971,179 | A | 7/1976 | Bodocsi et al. |
| 4,047,341 | A | 9/1977 | Bernardi |
| 4,125,978 | A | 11/1978 | Schildge, Jr. |
| 4,144,686 | A | 3/1979 | Gold |
| 4,275,537 | A | 6/1981 | Pinson |
| 4,393,637 | A | 7/1983 | Mosier |
| 4,607,470 | A | 8/1986 | Ecker |
| 4,631,883 | A | 12/1986 | Harris et al. |
| 4,676,045 | A | 6/1987 | Ellen |
| 4,890,437 | A | 1/1990 | Quaile |
| 5,050,366 | A | 9/1991 | Gardner et al. |
| 5,159,790 | A | 11/1992 | Harding |
| 5,175,968 | A | 1/1993 | Saucke |
| 5,218,801 | A | 6/1993 | Hereford |
| 5,299,445 | A | 4/1994 | Yee |
| 5,313,749 | A | 5/1994 | Conner |
| 5,426,899 | A | 6/1995 | Jones |
| 5,471,812 | A | 12/1995 | Muller |
| 5,487,242 | A | 1/1996 | Stafford |
| 5,671,572 | A | 9/1997 | Siller-Franco |
| 6,145,268 | A | 11/2000 | Korzen |
| 6,155,019 | A | 12/2000 | Ashton et al. |
| 6,892,410 | B2 | 5/2005 | Tokuno et al. |
| 7,721,496 | B2 | 5/2010 | Carlson et al. |
| 2002/0083659 | A1 | 7/2002 | Sorkin |
| 2002/0194808 | A1 | 12/2002 | Ratliff |
| 2003/0182886 | A1 | 10/2003 | Parrish |
| 2003/0213192 | A1 | 11/2003 | Pittman |
| 2004/0065030 | A1 | 4/2004 | Zambelli et al. |
| 2004/0148880 | A1 | 8/2004 | Hayes |

FOREIGN PATENT DOCUMENTS

| | | | |
|---|---|---|---|
| DE | 1 609 806 | A1 | 4/1970 |
| DE | 3 515 052 | A1 | 10/1986 |
| EP | 0 060 352 | A1 | 9/1982 |
| EP | 0 211 671 | A2 | 2/1987 |
| EP | 0 237 667 | A2 | 9/1987 |
| EP | 1 054 106 | A2 | 11/2000 |
| FR | 2 666 607 | A1 | 3/1992 |
| JP | 08-041820 | A | 2/1996 |
| JP | 11-158819 | A | 6/1999 |
| JP | 11-190100 | A | 7/1999 |
| WO | 93/22521 | A1 | 11/1993 |
| WO | 00/28168 | A1 | 5/2000 |
| WO | 01/42584 | A1 | 6/2001 |
| WO | 01/96679 | A1 | 12/2001 |

* cited by examiner

BUILDING METHODS

CROSS REFERENCE TO RELATED APPLICATIONS

This application is a continuation application of U.S. patent application Ser. No. 11/572,407, filed Jan. 19, 2007, which is a national phase application of International Application No. PCT/AU2005/001077, filed Jul. 21, 2005, designating the United States and claiming priority to Australian Patent Application No. 2004904034, filed Jul. 21, 2004, both of which are incorporated by reference herein in their entirety.

FIELD OF THE INVENTION

The present invention relates to a method of building a structure and also to a method to strengthening, or reducing the deflection of, a built structure.

The invention has been primarily developed for use in relation to steel portal frame structures and will be described hereinafter with reference to this application. However, the invention is not limited to this field of use and is also applicable for other structural and architectural works.

BACKGROUND OF THE INVENTION

When designing a structure or building, consideration must be given to, amongst others requirements, the requirements of strength, deflection and dynamics. It is common for additional material to be required in a structure to satisfy deflection requirements, when compared to the material required to satisfy strength requirements. The additional material increases material and construction costs and can also adversely affect the building's dynamic response (particularly to earthquakes) and also requires a corresponding increase in the building's foundations.

It is important that the amount of materials used in building structures is minimised from a cost and environmental standpoint. It is an object of the present invention to reduce the material required in a building whilst still satisfying deflection criteria.

SUMMARY OF THE INVENTION

Accordingly, in a first aspect, the present invention provides a method of building a structure, the method including the steps of:

1. fabricating a generally longitudinal, steel sub-structure of the structure with a cable retainer attached to, or forming part of, the sub-structure and that extends substantially longitudinally therealong;
2. assembling the sub-structure into a structure;
3. inserting a cable into the cable retainer;
4. after step 2, applying a tensile force to the cable, relative to the cable retainer; and
5. after step 4, bonding the cable to the cable retainer.

In a second aspect, the present invention provides a method of building a structure, the method including the steps of:

1. fabricating a generally longitudinal, steel sub-structure of the structure with a cable retainer attached to, or forming part of, the sub-structure and that extends substantially longitudinally therealong;
2. inserting cable into the cable retainer;
3. after step 2, applying a tensile force to the cable, relative to the cable retainer; and
4. after step 3, bonding the cable to the cable retainer; and
5. assembling the sub-structure into a structure.

In a third aspect, the present invention provides a method of strengthening, or reducing the deflection of, a built structure, the method including the steps of:

1. attaching a cable retainer to a generally longitudinal, steel sub-structure of the structure with the cable retainer extending substantially longitudinally therealong;
2. inserting cable into the cable retainer;
3. applying a tensile force to the cable, relative to the cable retainer; and
4. after step 3, bonding the cable to the cable retainer.

The cable retainers are adapted to follow the tensile line of resistance the sub-structure is subjected when loaded during use.

Preferably, the method includes assembling at least two sub-structures into a structure.

Preferably also, the method includes inserting at least two cables into the cable retainer.

The cable is preferably bonded to the cable retainer by any one of the following: welding, gluing (including grouting, most preferably with cementitous grout), or by expanding the cable retainer relative to the cable or shrinking the cable relative to the cable retainer (for example by heating the cable retainer and/or by cooling the cable and thereafter allowing them to shrink and/or expand into engagement with one another) prior to inserting the cable into the cable retainer.

The tensile force is preferably applied to the cable by jacking.

The structure is preferably a steel portal frame structure, more preferably produced from I or T section beams or from tubular truss assemblies.

When the sub-structure is in the form of an I or T section beam, the cable retainer are attached to the web of the beam and, most preferably, passes through the flange of the beam. When the sub-structure is a truss assembly, the cable retainer is in the form of one of the tubular members integral with the truss.

The sub-structure is preferably utilised in the centre span of the structure. However, the sub-structure can also be used in the columns or walls of the structure.

In one form, the cable retainer extends within the boundaries of its associated sub-structure. In another form, the cable retainer is attached to the sub-structure external the boundaries of sub-structure.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
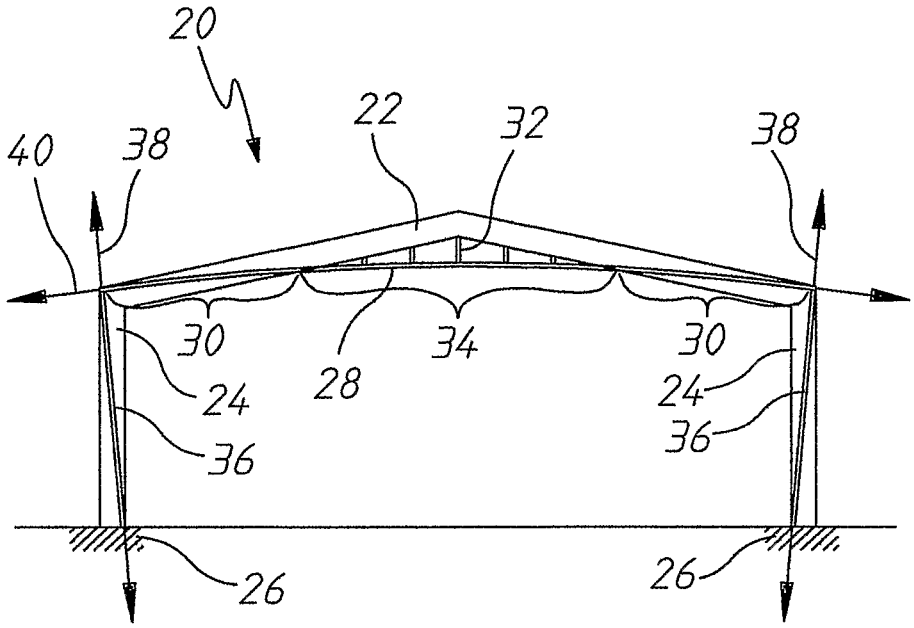
FIGS. 1 to 11 are each schematic cross-sectional drawings of structures utilising an embodiment of the invention.

FIG. 1 shows a steel portal frame structure 20 formed from a centre span 22, two columns 24 and two foundations 26. Each half of the centre span 22 and each of the columns 24 represent a sub-structure of the steel portal frame structure 20.

The centre span 22 has a first cable retainer 28 attached thereto, by welding in the regions 30 and via the struts 32 in the region 34. Each of the columns 24 also have cable retainers 36 attached thereto by welding.

Cables, represented by double headed arrows 38 and 40, are passed through the cable retainers 28 and 36 respectively. The cables 38, 40 are tensioned relative to the cable retainers 28, 36 respectively then bonded to the cable retainers 28, 36 respectively, prior to releasing the tension in the cables. The tensioning, bonding and releasing steps shall be described in more detail below.

The cable retainers 28, 36 extend generally along the longitudinal direction of their associated centre span (sub-structure) 22 or column (sub-structure) 24. More particularly, the cable retainers 28, 36 are positioned to follow the tensile line of resistance of their associated sub-structure when the structure 20 is subjected to its intended load during use.

For example, the steel portal frame structure 20 shown in FIG. 1 is designed to be subject to a downward and horizontal load/use and the cable retainers 28, 36 are thus oriented as shown to best resist deflection caused by that load.

The resulting structure is able to better resist deflection under its designed load conditions as the tension applied to the cables relative to their associated sub-structure stores strain energy in the resulting sub-structure. Accordingly, as forces are applied to structure, the counter strain stored in the sub-structure resists the application of that load.

The resulting structure can, within certain boundaries, accept load with reduced strain and thus has an increased load carrying capacity for a given deflection. A 50-100% reduction in deflection can result compared to a similar sized existing structure.

The steel portal frame structures shown in FIGS. 2-12 each have their components and sub-structures identified with like reference numerals to those used in FIG. 1. However, in each structure, the cable retainers follow a different path compared to the columns and centre span so as to suit differing load conditions.

Figure 2:
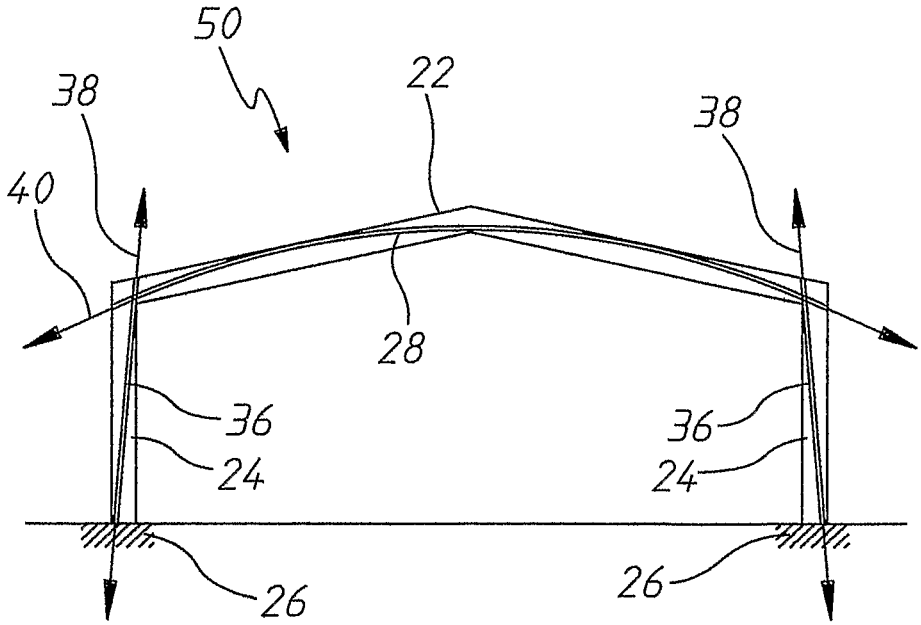

The structure 50 shown in FIG. 2 is designed to resist upward and horizontal load conditions/usage.

Figure 3:
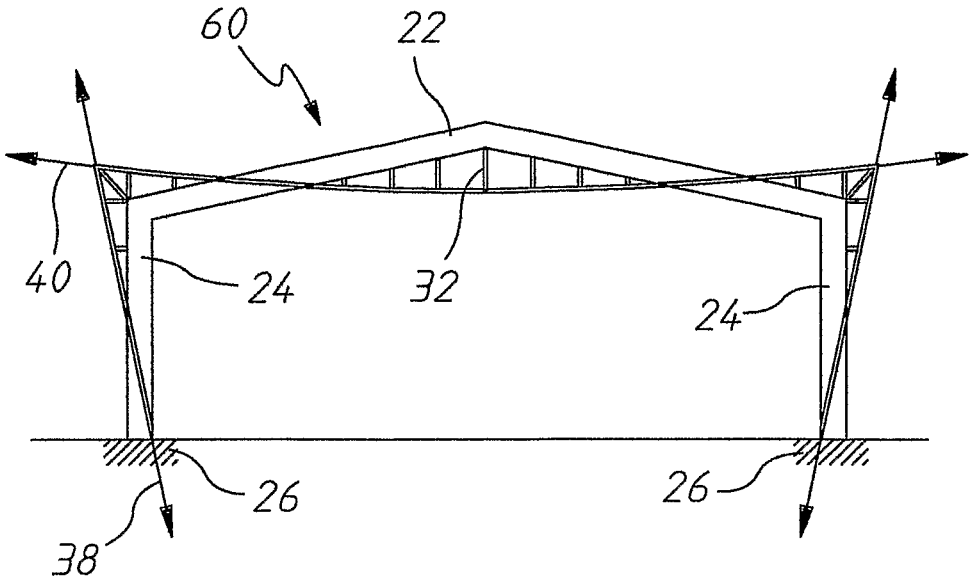

The structure 60 shown in FIG. 3 is designed to resist downward and horizontal load conditions/usage.

Figure 4:
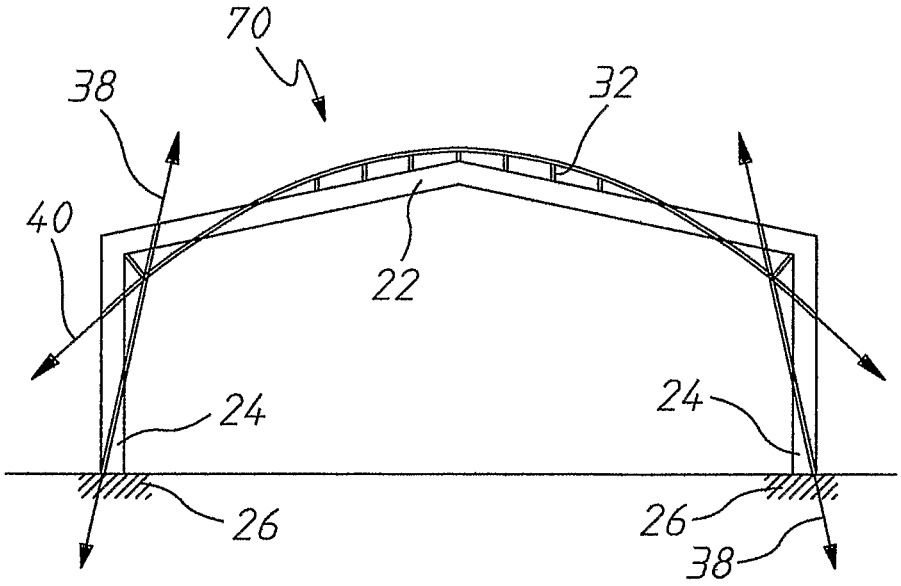

The structure 70 shown in FIG. 4 is designed to resist upward and horizontal load conditions/usage.

Figure 5:
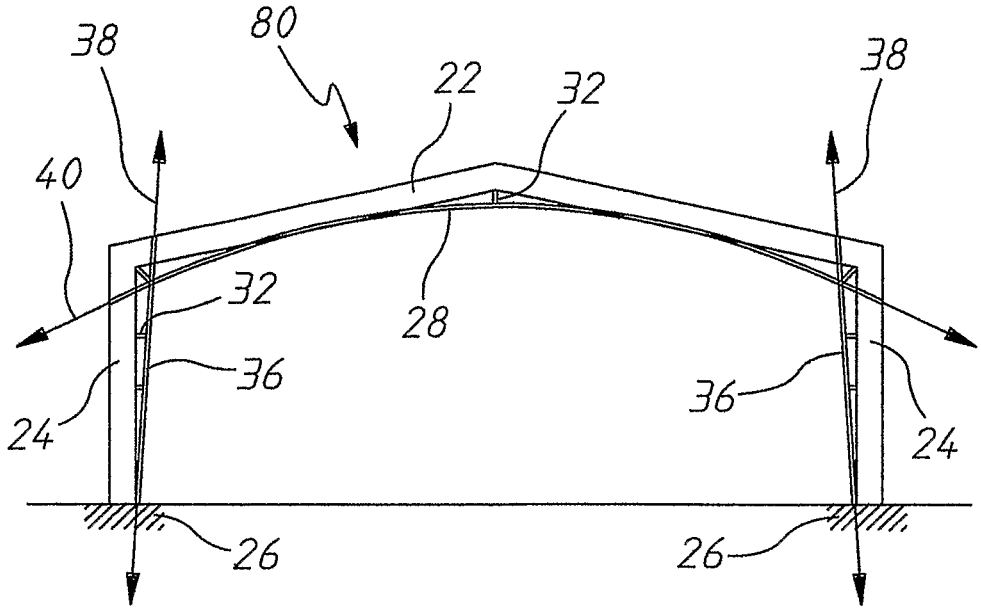

The structure 80 shown in FIG. 5 is designed to resist upward and horizontal load conditions/usage.

Figure 6:
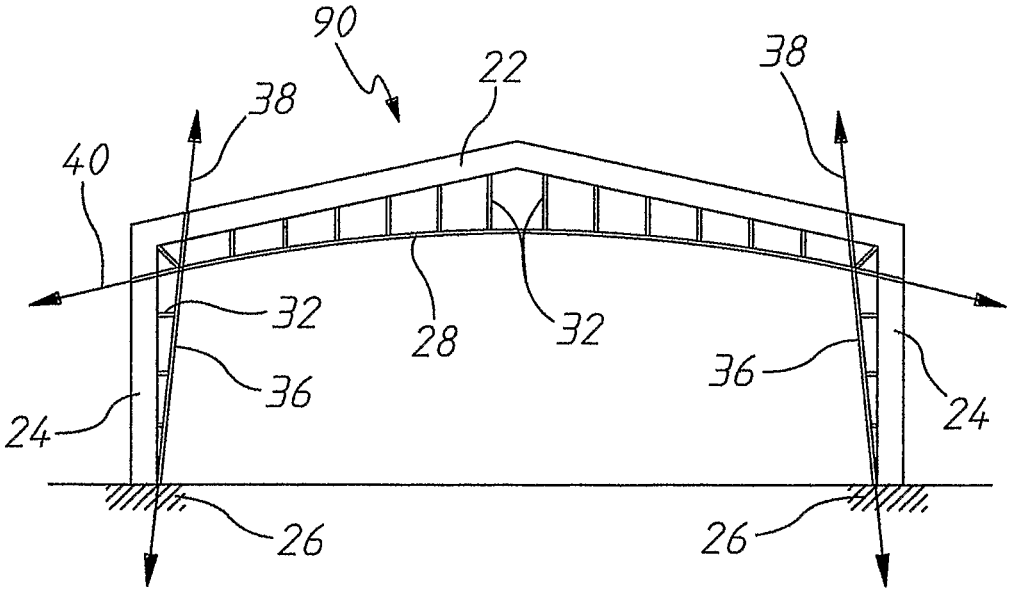

The structure 90 shown in FIG. 6 is designed to resist downward and horizontal load conditions/usage.

Figure 7:
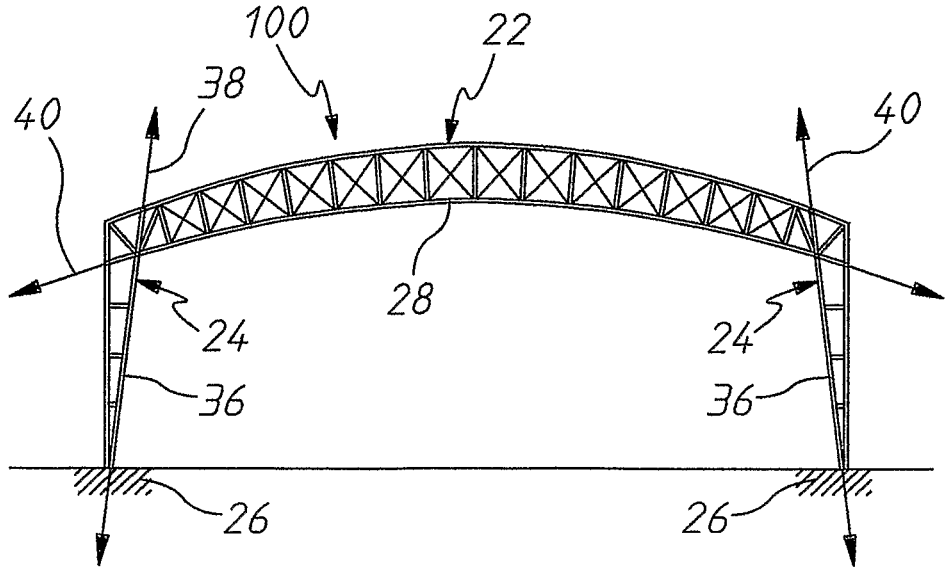

The structure 100 shown in FIG. 7 is designed to resist upward and horizontal load conditions/usage.

Figure 8:
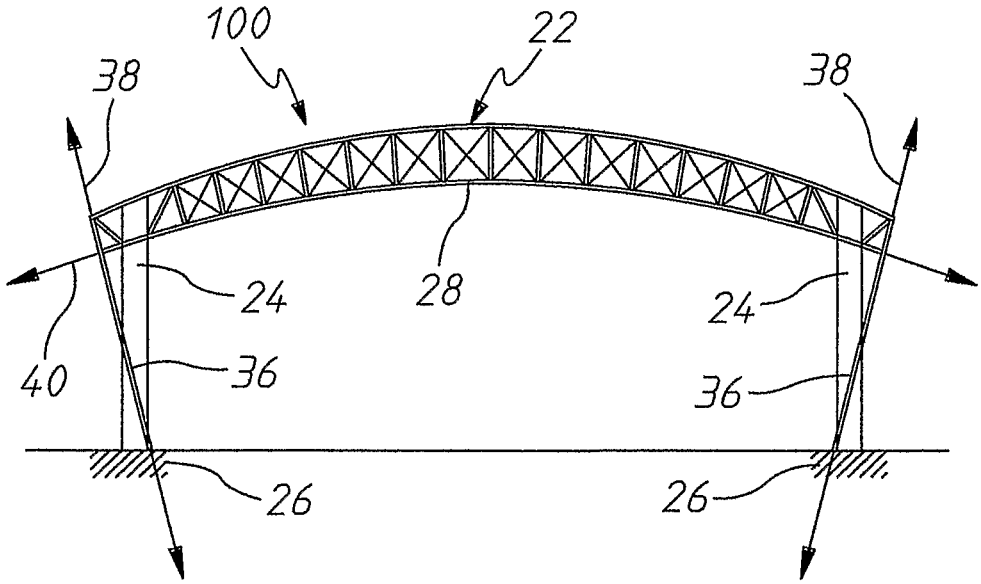

The structure 110 shown in FIG. 8 is designed to resist downward and horizontal load conditions/usage.

Figure 9:
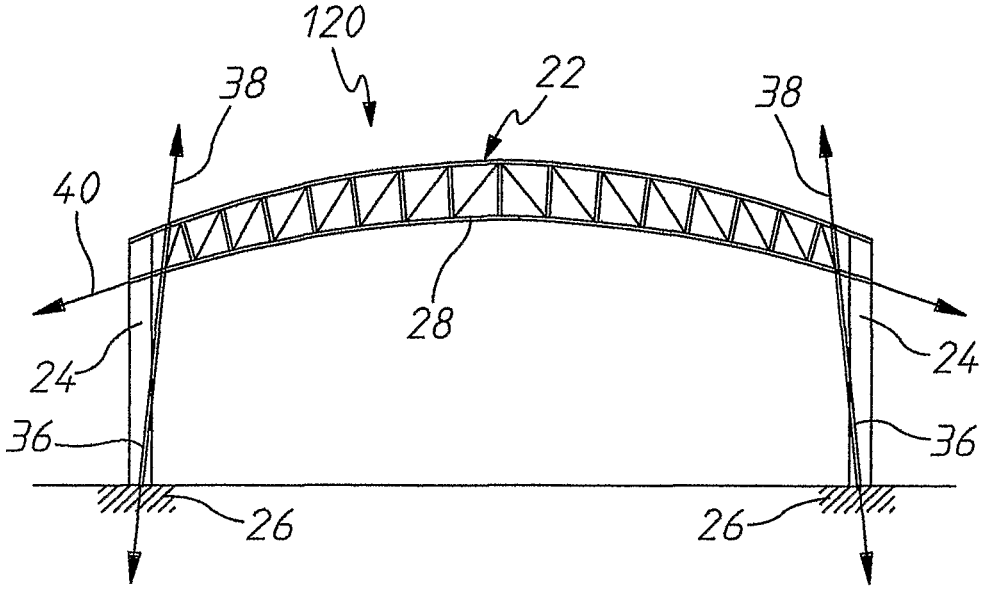

The structure 120 shown in FIG. 9 is designed to resist upward and horizontal load conditions/usage.

Figure 10:
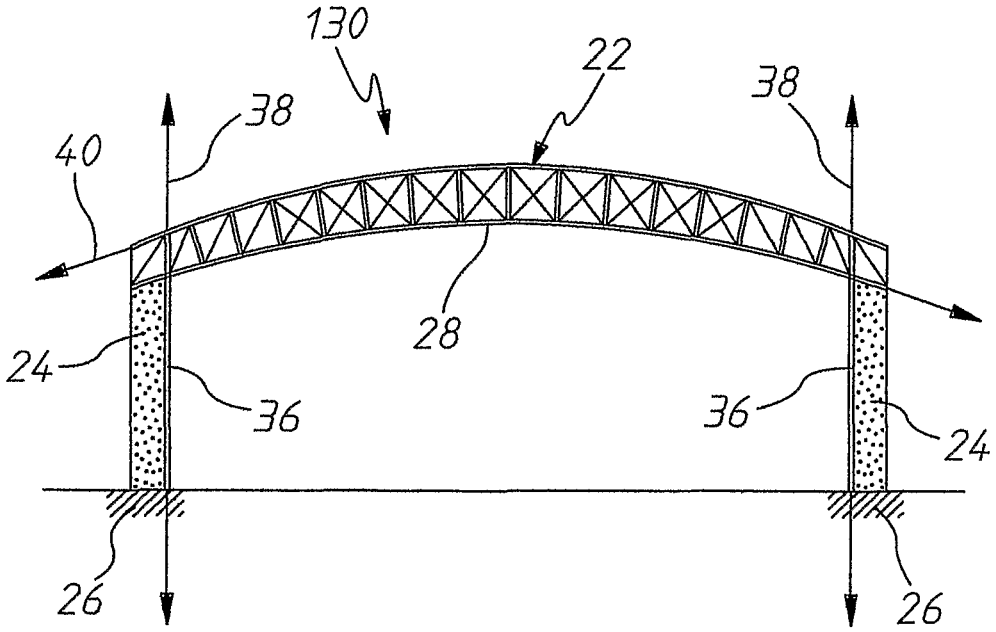

The structure 130 shown in FIG. 10 is designed to resist downward and horizontal load conditions/usage.

Figure 11:
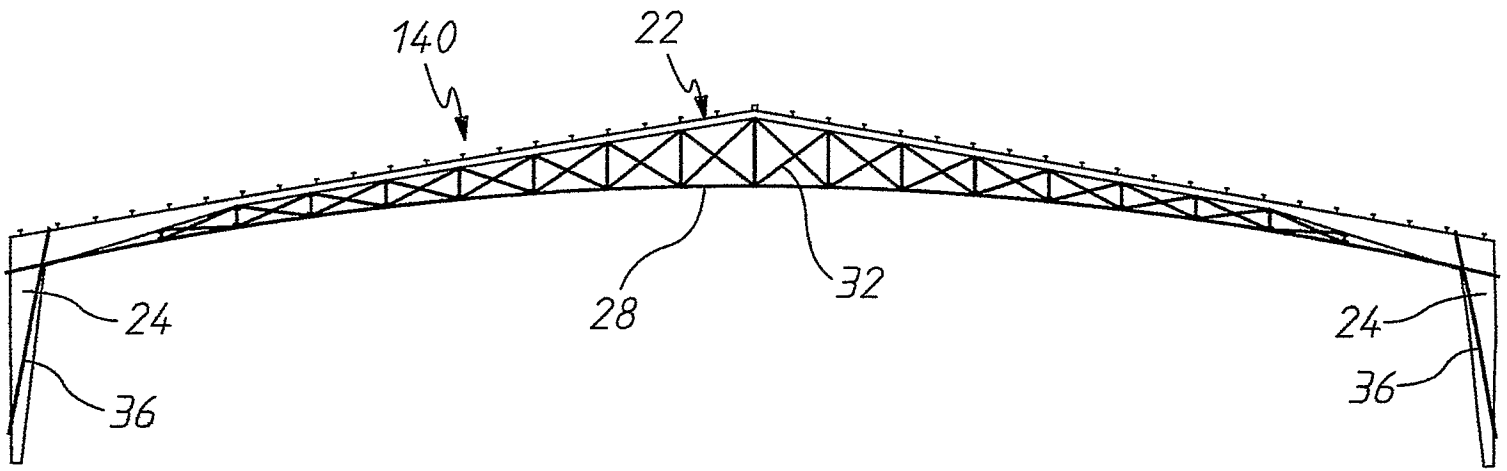

The structure 140 shown in FIG. 11 is designed to resist upward and horizontal load conditions/usage.

Figure 12:
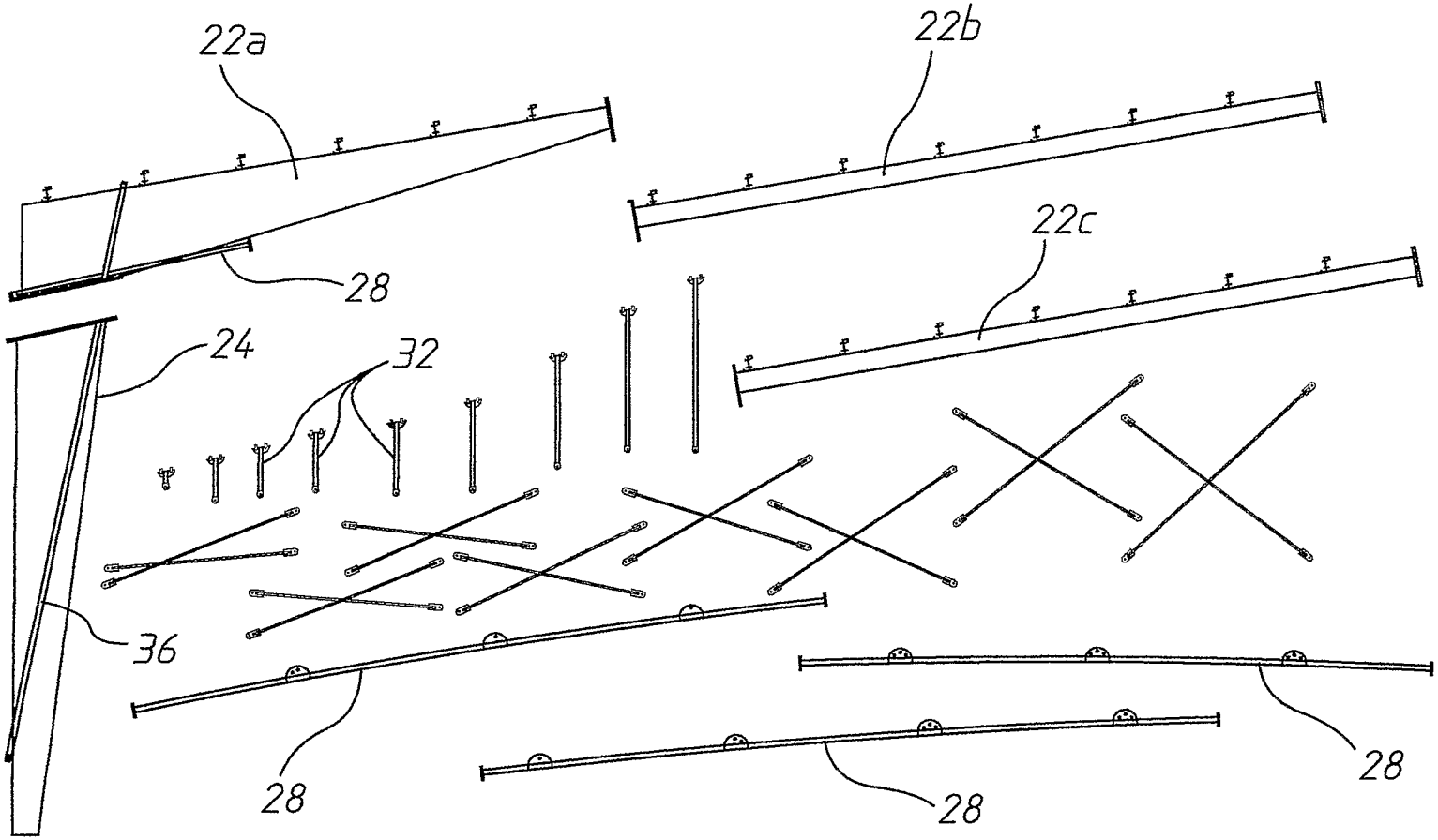
FIG. 12 is an exploded view of the sub-structures comprising the structure shown in FIG. 11.

FIG. 12 shows the various sub-structures that comprise the structure 140 shown in FIG. 11. As shown, the centre span 22 is formed from three sub-structures 22*a*, 22*b* and 22*c*. The structure 140 is preferably built by assembling all of the sub-structures into the final form shown in FIG. 11, inserting cables through the cable retainers, jacking the cables into a state of tension, bonding the cables to the cable retainers (for example with cementitous grout) and then releasing the jacking load on the cables.

As an alternative, one or more of the sub-structures can be assembled and tensioned according to the method described above, and then subsequently attached to the sub-structures. For example, the centre span sub-structure can be assembled on the ground and, after tensioned cables have been bonded thereto, be raised into its final position and connected to the column sub-structures.

As a further alternative, cable retainers can be added to a pre-existing structure, or a new structure built without them, which are then tensioned and bonded in the manner described above. This finds particular application in improving the strength and/or deflection performance of an existing built structure or structure whose design is complete.

Figure 13:
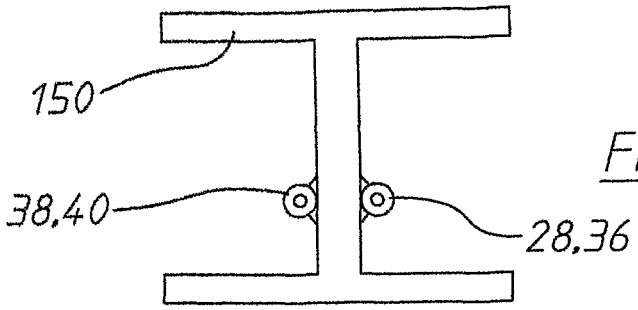
FIG. 13 is a cross-sectional end view of an embodiment of an I beam suitable for use in the structures shown in earlier drawings.
Figure 14:
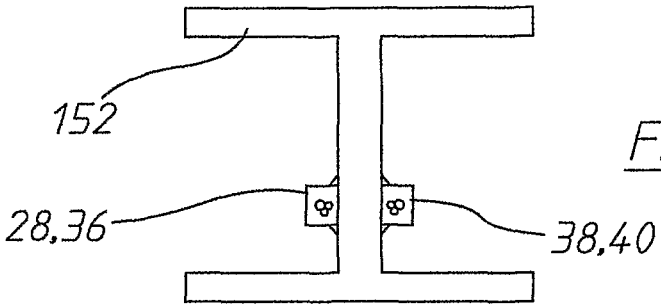
FIG. 14 is a cross-sectional end view of another embodiment of an I beam suitable for use in the structures shown in earlier drawings.

FIGS. 13 and 14 show examples of cable retainers 28, 36, in the form of steel tubes, being attached to beams 150 and 152, for example by welding, which are suitable for use in the previously described structures (for example, those structures shown in FIGS. 1 to 6).

Figure 15:
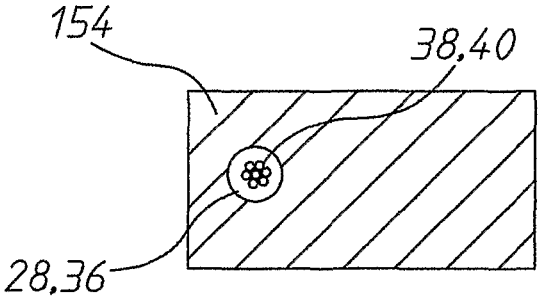
FIG. 15 is a cross-sectional end view of a further embodiment of a rectangular beam suitable for use in the structures shown in earlier drawings.

FIG. 15 shows an alternative beam 154 in which the cable retainer 28, 36 is in the form of an opening or hole or channel through the beam which is suitable for use in a previously described structure (for example, the structure shown in FIG. 10).

Figure 16:
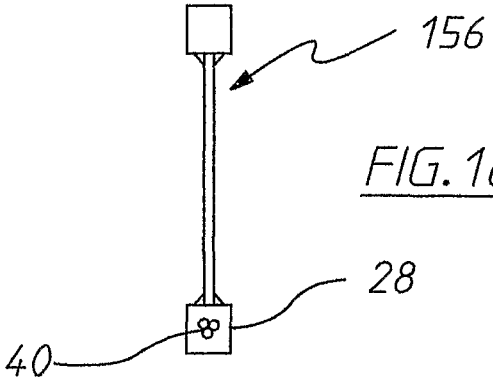
FIG. 16 is a cross-sectional end view of an embodiment of a truss assembly suitable for use in the structures shown in earlier drawings.

FIG. 16 shows an example of cable retainers 28, 36, in the form of steel tubes, being part of a truss assembly 156, which is suitable for use in the previously described structures (for example, those structures shown in FIGS. 7 to 10).

The structures described above can be designed to meet strength and dynamic requirements, whilst reducing the need to increase the material added to the structure to satisfy deflection requirements. The embodiments described previously advantageously enable the span of a structure to be increased whilst using the same amount of materials to thus provide a larger structure for the same material cost. Conversely, a structure with a like span to an existing structure can be produced using a reduced amount of materials. The structures described above are also lighter and cheaper than existing comparable structures, particularly when foundation saving are taken into account.

Although the invention has been described with reference to specific embodiments, it would be appreciated by those skilled in the art that the invention can be embodied in many other forms. For example, the cable retainers can be of any shape and any number of cables can be inserted therein.

The invention claimed is:

1. A method of building a portal frame structure, the method including the steps of:

(a) fabricating a first generally longitudinal, steel wall sub-structure of the portal frame structure with a first cable retainer attached to, or forming part of, the first wall sub-structure and that extends substantially longitudinally therealong;

(b) fabricating a second generally longitudinal, steel wall sub-structure of the portal frame structure with a second cable retainer attached to, or forming part of, the second wall sub-structure and that extends substantially longitudinally therealong;

(c) fabricating a generally longitudinal, steel centre span sub-structure of the portal frame structure with a third cable retainer attached to, or forming part of, the centre span sub-structure and that extends substantially longitudinally therealong;

(d) assembling the first wall, second wall and centre span sub-structures into the portal frame structure in an assembled configuration;

(e) inserting first, second and third cables into the first, second and third cable retainers respectively;

(f) after step (d), applying tensile force to the first, second and third cables, relative to the first, second and third cable retainers respectively; and (g) after step (f), bonding the first, second and third cables to the first, second and third cable retainers respectively to substantially maintain the portal frame structure in the assembled configuration, wherein the first, second and third cable retainers are in the form of tubular members which follow a respective tensile line of resistance the first, second and third sub-structures are subjected to when loaded during intended use, at least a portion of at least one of the first, second and third cable retainers being coupled to and positioned outwardly beyond an external boundary surface of the respective sub-structure when in the assembled configuration so as to have at least a 50% reduction in deflection of the portal frame structure when under load compared to a portal frame structure which does not include cables following tensile lines of resistance, and wherein the first wall, second wall and centre span sub-structures do not substantially change shape or change positioning from the assembled configuration when tensile force is applied to the first, second and third cables in step (f).

2. The method as claimed in claim 1, wherein the method includes inserting at least two cables into one or more of the first, second and third cable retainers.

3. The method as claimed in claim 1, wherein the tensile force is applied to the first, second and third cables by jacking.

4. The method as claimed in claim 1, wherein the sub-structures are produced from I or T section beams or from tubular truss assemblies.

5. The method as claimed in claim 1, wherein the sub-structures are produced from I or T section beams having at least one web and at least one flange, and the respective cable retainers are attached to the web of the respective beam.

6. The method as claimed in claim 5, wherein the cables pass through the flanges of the respective beams.

7. The method as claimed in claim 1, wherein the sub-structures are truss assemblies, and each of the cable retainers is a tubular member integral with the respective truss assemblies.

8. The method as claimed in claim 1, wherein at least a portion of the third cable retainer extends below an apex of the centre span sub-structure and is configured to be subjected to downward and horizontal directed loads during intended use.

9. The method as claimed in claim 1, wherein at least a portion of the third cable retainer extends above an apex of the centre span sub-structure and is configured to be subjected to upward and horizontal directed loads during intended use.

10. A method of building a portal frame structure, the method including the steps of:

(a) fabricating a first generally longitudinal, steel wall sub-structure of the portal frame structure with a first cable retainer attached to, or forming part of, the first sub-structure and that extends substantially longitudinally therealong;

(b) fabricating a second generally longitudinal, steel wall sub-structure of the portal frame structure with a second cable retainer attached to, or forming part of, the second sub-structure and that extends substantially longitudinally therealong;

(c) fabricating a generally longitudinal, steel centre span sub-structure of the portal frame structure with a third cable retainer attached to, or forming part of, the third sub-structure and that extends substantially longitudinally therealong;

(d) inserting first, second and third cables into the first, second and third cable retainers respectively;

(e) after step (d), applying tensile force to the first, second and third cables, relative to the first, second and third cable retainers respectively;

(f) after step (e), bonding the first, second and third cables to the first, second and third cable retainers respectively to maintain each of the first wall, second wall and the centre span sub-structures in respective tensioned configurations; and (g) assembling the first wall, second wall and centre span sub-structures into the portal frame structure with the first wall, second wall and centre span sub-structures being substantially maintained in the respective tensioned configurations, wherein the first, second and third cable retainers are in the form of tubular members which follow a respective tensile line of resistance the first, second and third sub-structures are subjected to when loaded during intended use, at least a portion of at least one of the first, second and third cable retainers being coupled to and positioned outwardly beyond an external boundary surface of the respective sub-structure when in an assembled configuration so as to have at least a 50% reduction in deflection of the portal frame structure when under load compared to a portal frame structure which does not include cables following tensile lines of resistance, and wherein the first wall, second wall and centre span sub-structures do not substantially change shape when tensile force is applied to the first, second and third cables in step (e).

11. The method as claimed in claim 10, wherein at least a portion of the third cable retainer extends below an apex of the centre span sub-structure and is configured to be subjected to downward and horizontal directed loads during intended use.

12. The method as claimed in claim 10, wherein at least a portion of the third cable retainer extends above an apex of the centre span sub-structure and is configured to be subjected to upward and horizontal directed loads during intended use.

13. A method of strengthening, or reducing deflection of, a built portal frame structure in an assembled configuration comprising a first generally longitudinal, steel wall sub-structure, a second generally longitudinal, steel wall sub-structure and a third generally longitudinal, steel centre span sub-structure, the method including the steps of:

(a) attaching first, second and third cable retainers to the first, second and third sub-structures of the built portal frame structure respectively, with the first, second and third cable retainers extending substantially longitudinally therealong the first, second and third sub-structures respectively;

(b) inserting first, second and third cables into the first, second and third cable retainers respectively;

(c) applying a tensile force to the first, second and third cables, relative to the first, second and third cable retainers respectively; and (d) after step (c), bonding the first, second and third cables to the first, second and third cable retainers respectively to substantially maintain the built portal frame structure in the assembled configuration, wherein the first, second and third cable retainers are in the form of tubular members which follow a respective tensile line of resistance the first, second and third sub-structures are subjected to when loaded during intended use, at least a portion of at least one of the first, second and third cable retainers being coupled to and positioned outwardly beyond an external boundary surface of the built portal frame structure when in the assembled configuration so as to have at least a 50% reduction in deflection of the portal frame structure when under load compared to a portal frame structure which does not include cables following tensile lines of resistance, and wherein the first wall, second wall and centre span sub-structures do not substantially change shape or change positioning from the assembled configuration when tensile force is applied to the first, second and third cables in step (c).

14. The method as claimed in claim 13, wherein at least a portion of the third cable retainer extends below an apex of the centre span sub-structure and is configured to be subjected to downward and horizontal directed loads during intended use.

15. The method as claimed in claim 13, wherein at least a portion of the third cable retainer extends above an apex of the centre span sub-structure and is configured to be subjected to upward and horizontal directed loads during intended use.

* * * * *